US011122897B2

(12) United States Patent
Decker et al.

(10) Patent No.: US 11,122,897 B2
(45) Date of Patent: Sep. 21, 2021

(54) DISPLAY MOUNTING SYSTEM AND METHOD OF MANUFACTURING OUTRIGGERS

(71) Applicant: RCS Systems, Inc., Milwaukee, WI (US)

(72) Inventors: Troy S. Decker, Germantown, WI (US); Clifford R. Winn, Hubertus, WI (US); James Ziehr, Milwaukee, WI (US); Kyle Kleist, Milwaukee, WI (US); Tyler Lathrop, Janesville, WI (US); Karen Papiese, University Park, FL (US); Eric Beele, University Park, FL (US); Frank Opiola, University Park, FL (US); Larry Markel, University Park, FL (US)

(73) Assignee: RCS Syslems, Inc., Milwaukee, WI (US)

( * ) Notice: Subject to any disclaimer, the term of this patent is extended or adjusted under 35 U.S.C. 154(b) by 106 days.

(21) Appl. No.: 15/948,852

(22) Filed: Apr. 9, 2018

(65) Prior Publication Data

US 2019/0104848 A1 Apr. 11, 2019

Related U.S. Application Data

(60) Provisional application No. 62/483,148, filed on Apr. 7, 2017.

(51) Int. Cl.
*A47B 96/14* (2006.01)
*A47G 1/16* (2006.01)
(Continued)

(52) U.S. Cl.
CPC ..... *A47B 96/1458* (2013.01); *A47B 51/00* (2013.01); *A47B 57/10* (2013.01);
(Continued)

(58) Field of Classification Search
CPC . A47B 96/14; A47B 96/1416; A47B 96/1433; A47B 96/145; A47B 96/1458;
(Continued)

(56) References Cited

U.S. PATENT DOCUMENTS 1,815,858 A * 7/1931 Lifschultz ..... A47F 5/101 211/182
4,567,698 A * 2/1986 Morrison ..... A47B 83/001 160/135
(Continued)

*Primary Examiner* — Rodney Mintz
(74) *Attorney, Agent, or Firm* — James A. Joyce; Godfrey & Kahn, S.C.

(57) ABSTRACT

A display mounting system having outriggers for supporting removably mountable support brackets, including at least two outriggers and at least two support brackets. In one embodiment, the outriggers each include a center tube, two end C-channels, and a side U-channel. Each of the end C-channels connects lengthwise to narrower sides of the center tube. The side U-channel connects lengthwise to one of the wider sides of the center tube. Each center tube includes at least two rows of slots formed in at least one of the wider sides of the center tube, along the length of the center tube. The support brackets are mounted by engagement with at least some of the slots. In another embodiment, the outrigger includes a rectangular slotted mounting plate slid into an extruded frame, the frame having at least two elongated entry slots formed substantially parallel to each other by which to access the plate.

8 Claims, 13 Drawing Sheets

(51) Int. Cl.
*A47B 57/10* (2006.01)
*A47B 51/00* (2006.01)
*A47B 81/06* (2006.01)

(52) U.S. Cl.
CPC ..... *A47B 96/1408* (2013.01); *A47G 1/1653* (2013.01); *A47B 81/064* (2013.01); *A47B 2220/0077* (2013.01); *A47B 2220/0091* (2013.01)

(58) Field of Classification Search
CPC . A47B 96/1466; A47B 96/1475; A47B 96/06; A47B 96/061; A47B 51/10; A47B 51/12; A47F 5/103; A47F 5/101; E04C 3/08; E04B 2/7437; E04B 2/7809; E04B 2/7818; E04B 2/7836; E04B 2/7827; E04B 2/7863; E04B 2/7872; E04B 2002/742; E04B 2002/7483
USPC ..... 211/189–193, 204, 206
See application file for complete search history.

(56) References Cited

U.S. PATENT DOCUMENTS 4,584,804 A * 4/1986 Tajima ..... E04B 2/76 52/235
4,617,776 A * 10/1986 Bergstrom ..... E04C 2/34 52/1
4,716,692 A * 1/1988 Harper ..... E04B 2/7425 52/239
4,796,541 A * 1/1989 Halstrick ..... A47B 57/402 108/107
4,894,974 A * 1/1990 Mayhew ..... E04C 2/36 52/668
5,065,873 A * 11/1991 Tseng ..... A47B 57/54 108/107
5,157,892 A * 10/1992 Ryther ..... E04C 2/36 52/668
5,813,737 A * 9/1998 Stone ..... F16B 12/48 108/155
6,883,277 B2 * 4/2005 Wiechecki ..... E04B 2/7427 52/238.1
8,640,429 B1 * 2/2014 Watts ..... E04C 3/28 52/838
8,651,300 B2 * 2/2014 Chen ..... A47B 47/024 211/187
9,831,642 B2 * 11/2017 Woodley ..... A47B 97/00
10,428,515 B2 * 10/2019 Tang ..... E04B 1/2403
10,905,259 B2 * 2/2021 Spain, Jr. ..... A47F 5/0018
11,026,509 B2 * 6/2021 Walker ..... A47B 96/20
2001/0045404 A1 * 11/2001 Pellegrino ..... F16B 7/0446 211/192
2002/0053180 A1 * 5/2002 McGrath ..... E04B 2/7863 52/481.1
2002/0066253 A1 * 6/2002 Smith ..... E04C 3/16 52/837
2002/0157329 A1 * 10/2002 Berdan, II ..... E04B 9/06 52/144
2003/0089057 A1 * 5/2003 Wiechecki ..... E04B 2/745 52/238.1
2006/0096939 A1 * 5/2006 Liu ..... A47B 47/024 211/189
2007/0210226 A1 * 9/2007 Thum ..... A47B 96/06 248/220.31
2012/0298607 A1 * 11/2012 Chen ..... A47B 57/265 211/186
2014/0263130 A1 * 9/2014 Davis ..... A47B 47/042 211/182
2015/0211224 A1 * 7/2015 Timmerman, Sr. ..... E04C 3/32 52/634
2016/0220019 A1 * 8/2016 Cooper ..... A47B 45/00
2016/0333582 A1 * 11/2016 Xykis ..... E04B 1/34336
2017/0307130 A1 * 10/2017 Kohshima ..... A47F 5/00
2017/0310090 A1 * 10/2017 Woodley ..... A47B 97/00
2018/0237183 A1 * 8/2018 McGhee, III ..... A47B 87/007
2018/0245331 A1 * 8/2018 Tang ..... E04C 3/32
2018/0245356 A1 * 8/2018 Muth ..... F16M 13/022
2018/0290042 A1 * 10/2018 Vester ..... A47F 5/101
2019/0104848 A1 * 4/2019 Decker ..... A47B 96/1408
2019/0328134 A1 * 10/2019 Walker ..... A47B 57/482
2020/0069083 A1 * 3/2020 Spain, Jr. ..... A47F 5/083

* cited by examiner

DISPLAY MOUNTING SYSTEM AND METHOD OF MANUFACTURING OUTRIGGERS

CROSS REFERENCE TO RELATED APPLICATION

This application claims the benefit of U.S. Provisional Patent Application Ser. No. 62/483,148, filed Apr. 7, 2017. All of the information disclosed in that application is hereby incorporated herein by reference in its entirety.

FIELD OF THE INVENTION

This invention relates to the field of modular rack storage and display systems, and in particular to methods of manufacturing upright supports.

BACKGROUND

There is a need in the market for a flexible and easy-to-use modular system for supporting display units including shelves, and also other types of display units including display boxes, monitors, lighting, graphic frames such as for posters, and so on.

SUMMARY OF THE INVENTION

The present invention relates to a display mounting system having outriggers for supporting removably mountable support brackets. According to the invention the display mounting system has at least two outriggers and at least two support brackets. The outriggers each have a center tube, a first end C-channel, a second end C-channel, and at least one side U-channel. The center tube has a length, two narrower sides, and two wider sides. Each of the first and second end C-channels are connected lengthwise to opposite narrower sides of the center tube. At least one side U-channel is connected lengthwise to one of the wider sides of the center tube. Each center tube has at least two rows of slots formed in at least one of the wider sides of the center tube, along the length of the center tube. Of the at least two support brackets, one of the support bracket is removably mounted to each outrigger opposite the other support bracket. The support brackets are mounted by engagement with at least some of the slots.

In another aspect of this invention, the display mounting system has at least two outriggers, at least two support brackets, a shelf supported on the support brackets, and a wire chase mounted to the underside of the shelf. The outriggers each have rows of slots formed therein along the length thereof. One of the support brackets is removably mounted to each outrigger opposite the other support bracket.

In another aspect of the invention, the display mounting system has at least one rectangular slotted mounting plate and an extruded frame. The rectangular slotted mounting plate is comprised of a first material. The extruded frame is comprised of a second material and has at least two elongated entry slots formed substantially parallel to one another, into one of which the slotted mounting plate is inserted lengthwise. The slotted mounting plate remains accessible to a removably mounted support bracket after being inserted into the respective elongated entry slot.

In another aspect of the invention, the bracket is used with the display mounting system, the display mounting system having at least two rows of slots to engage the bracket. The bracket has a mounting portion and a support portion. The mounting portion has a pair of parallel sides spaced apart by a central web perpendicular to the parallel sides. Each of the parallel sides has an upper ear and a lower ear.

Other objects of the invention will become apparent hereinafter.

DETAILED DESCRIPTION

In general terms, the modern retail business is in competition with internet sales and other types of sales outlets. In order to attract customers, modern retail stores must be pleasant and inviting, and are therefore open, well-lit, and airy. They must also be flexible, at the least in terms of being able to configure and re-configure product displays. In order to provide the light and flexibility, companies operating the stores demand fixtures that are flexible and easily changed, of sufficient strength to support the intended product and display items, and yet not overly expensive. The present invention provides the means to achieve this strength and flexibility, with efficiency and at low cost.

When the term "substantially" is used herein, the term is used to allow for tolerances planned for and assumed to exist in real-world manufacturing. That is, for example, "substantially one inch" would mean exactly one inch, plus or minus conventional tolerances, and "substantially vertical" would mean exactly vertical, allowing for conventional tolerances.

Figure 1:
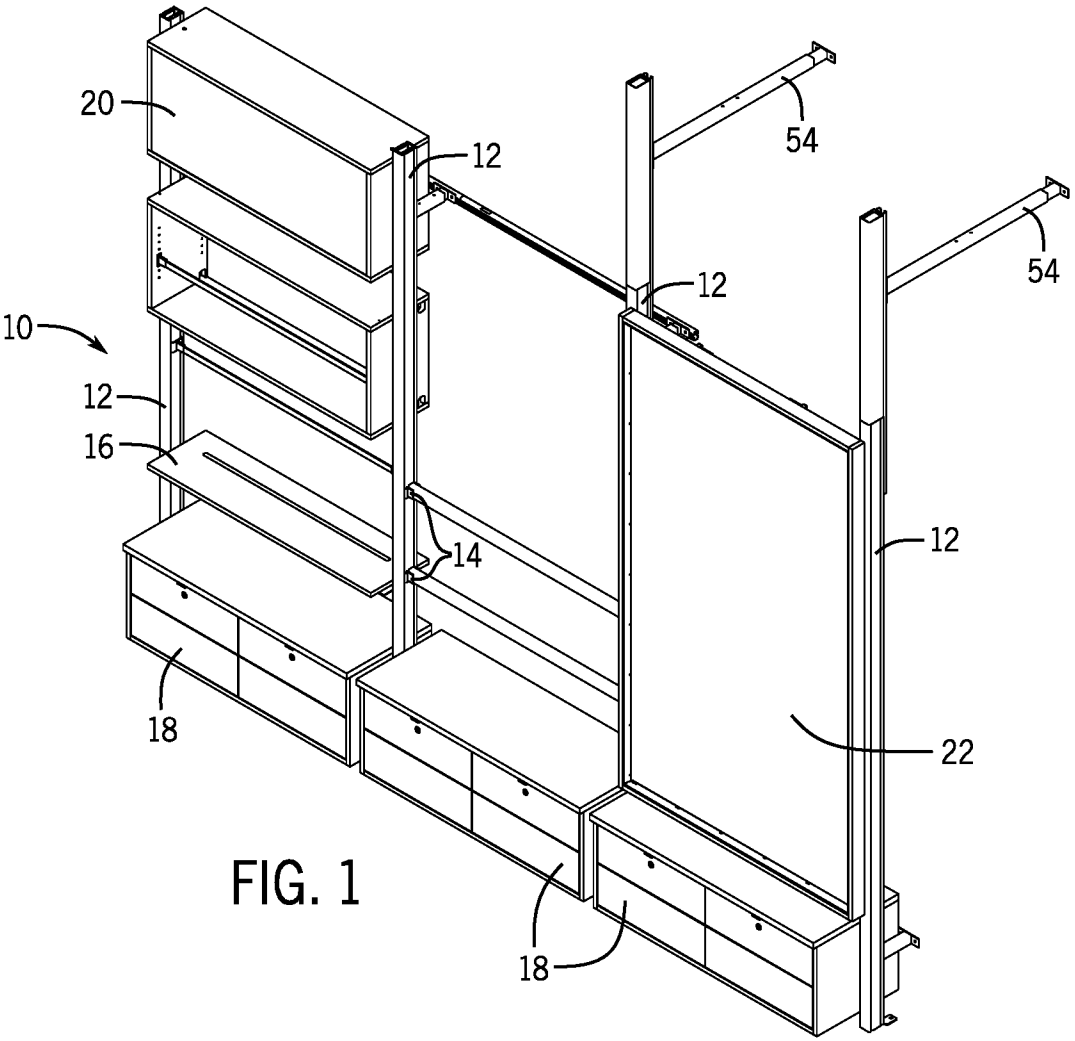
FIG. 1 is an isometric view of a display mounting system according to one embodiment of the invention.
Figure 2:
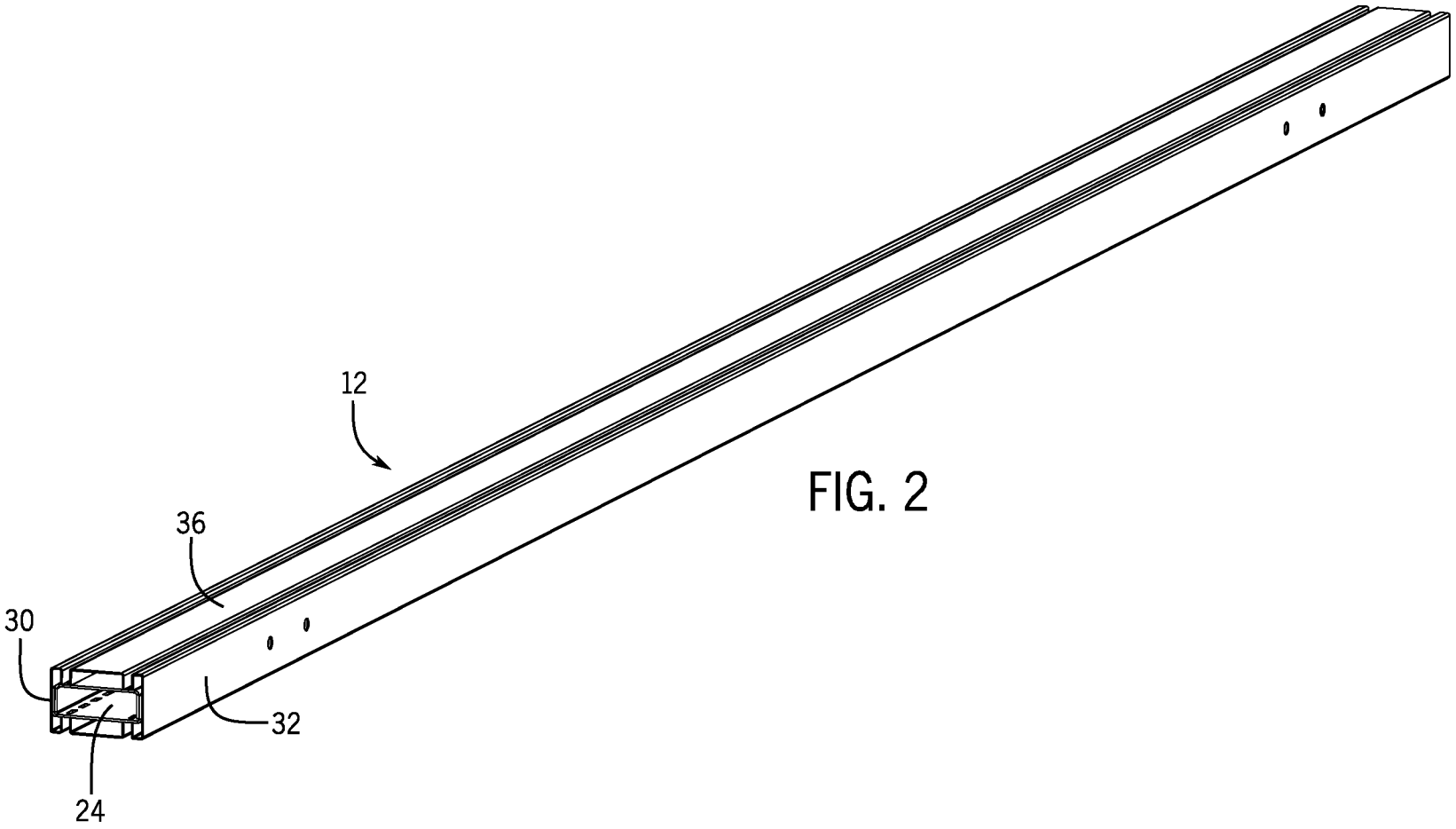
FIG. 2 is an isometric view of an outrigger constructed according to the invention.
Figure 3:
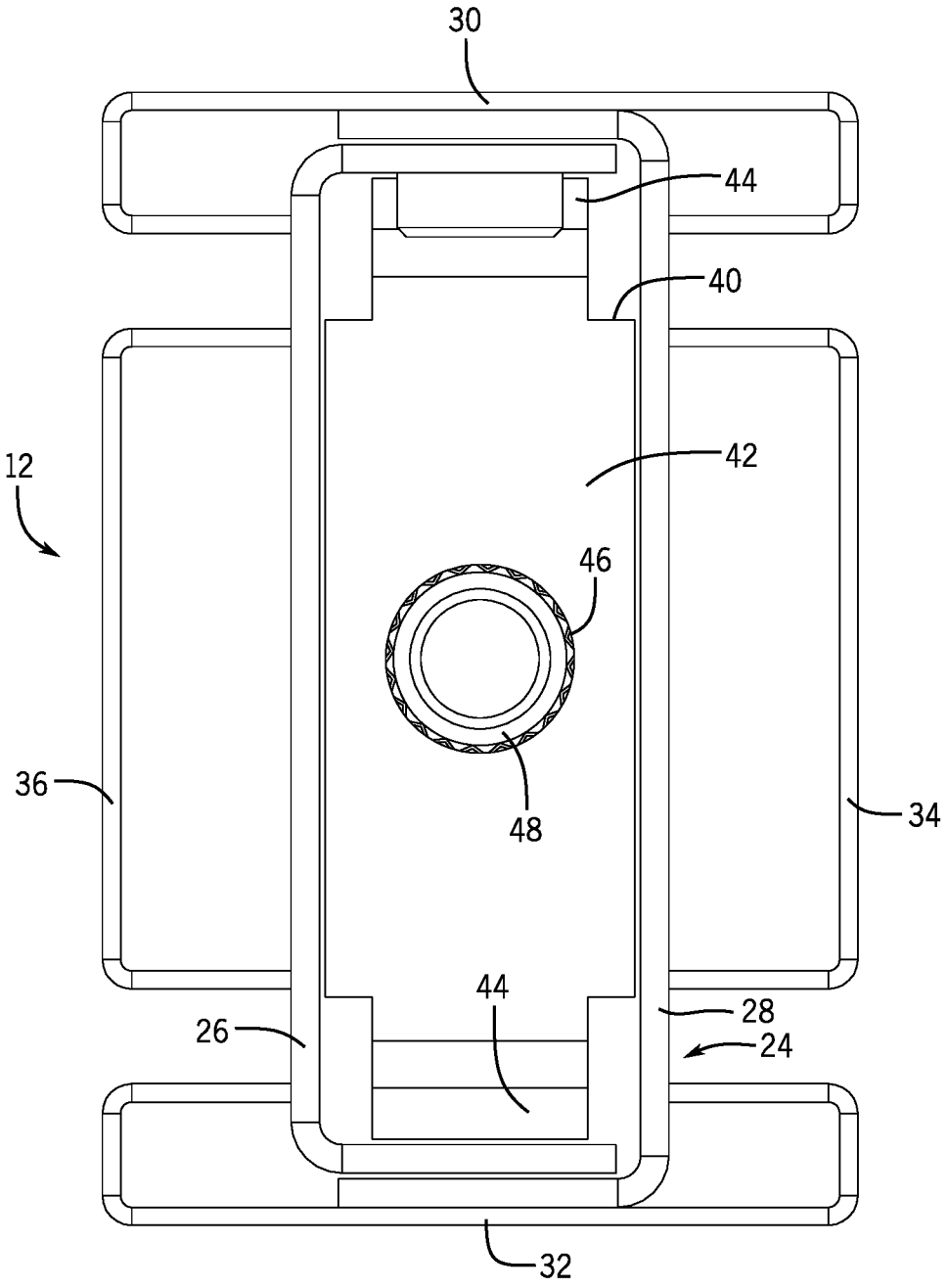
FIG. 3 is an end view of the outrigger shown in FIG. 2, enlarged.

Referring now to FIG. 1, the invention provides a system 10 of outriggers 12 which act as vertical standards, to which can be attached a variety of supports 14, so as to support various types of display items, such as shelves 16, bunkers 18, frames 20 for graphic displays such as posters and other graphics, and display monitors 22, as well as other types of display items.

FIGS. 2-5 show details of the outriggers 12 constructed according to one embodiment of the invention. As there shown, the outriggers 12 may be constructed of multiple parts. A center rectangular tube 24 may be constructed of two slotted U-channels, an inner slotted U-channel 26 and an outer slotted U-channel 28. As shown best in FIGS. 3 and 4, the slotted U-channel 26 is formed of a web portion 26*a*, having formed at each edge thereof a respective leg 26*b* and 26*c*, each substantially perpendicular to the web, with the width of the web being more than the width of the legs. Similarly, the slotted U-channel 28 is formed of a web portion 28*a*, having formed substantially perpendicularly at each edge thereof a respective leg 28*b* and 28*c*, with again the width of the web being larger than the width of the legs. In the embodiment shown in FIGS. 2-5, the legs 26*b*, 26*c*, 28*b* and 28*c* are all substantially the same length. The width of the web portion 26*a* of the inner slotted U-channel 26, however, is shorter than the width of the web portion 28*a* of the outer slotted U-channel 28, by just a bit more than double the thickness of one of the legs 26*b*, 26*c*. In this way, inner slotted U-channel 26 will nest within outer slotted U-channel 28 to form the tube 24, with the webs 26*a*, 28*a* forming the longer sides of the tube, the legs 28*b*, 28*c* forming the shorter sides of the tube, and the distal edges of the legs 26*b*, 26*c* between the legs 28*b*, 28*c*, and nearly contacting the web 28*a*.

Figure 4:
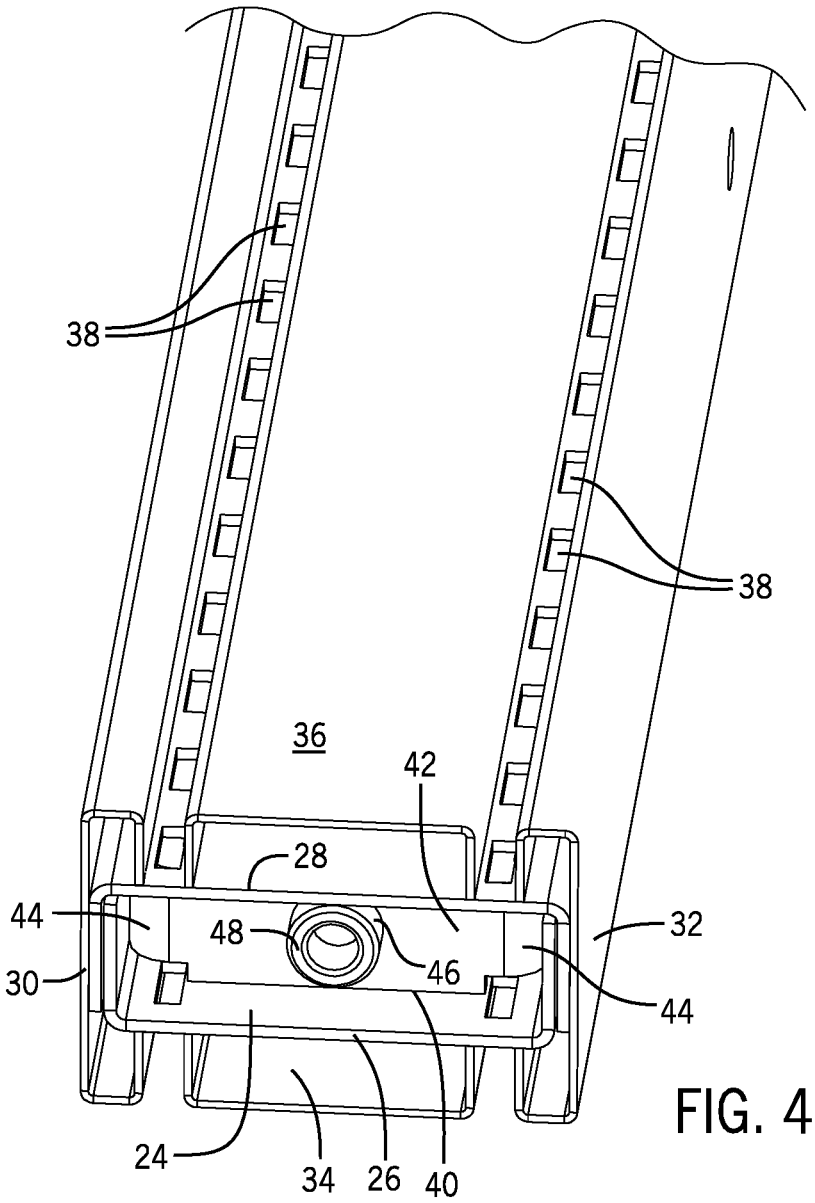
FIG. 4 is an isometric view of the end of the outrigger shown in FIGS. 2 and 3, to reveal the details of the end of the outrigger more clearly.
Figure 5:
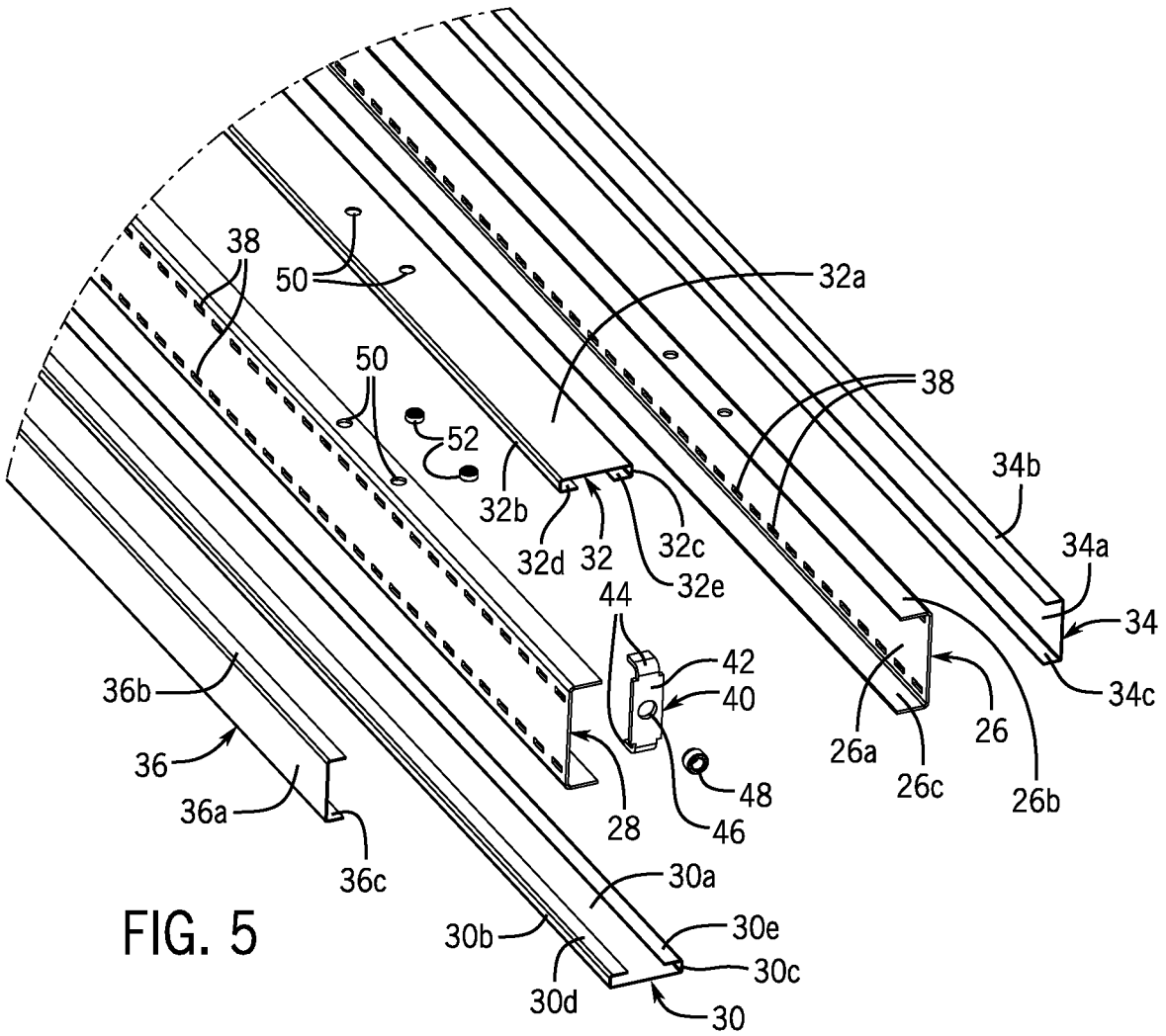
FIG. 5 is an exploded isometric view of the outrigger shown in FIGS. 2-4.

As shown best in FIGS. 4 and 5, the inner slotted U-channel 26 and the outer slotted U-channel 28 have formed therein, near the edges, two rows of slots 38. Although different arrangements would certainly work, in the embodiment shown, the slots 38 are formed to be about 5/32" wide and about 17/32" long. The slots 38 are spaced apart from each other within the same row at substantially one inch on center. The rows of slots 38 are spaced apart from each other by nearly the width of the web 26*a*, 28*a*, about two inches from center of slot to center of slot.

To each of the shorter sides of tube 24 is connected one of a first end plain C-channel 30 and a second end plain C-channel 32, each generally of a thinner gauge material than the slotted U-channels 26, 28. Each of the first end plain C-channels 30 includes a web 30*a*. Along the length of each side edge of the web 30*a* is formed substantially perpendicularly a respective leg 30*b*, 30*c*. To the distal edge of each respective leg 30*b*, 30*c* is formed a respective flange 30*d*, 30*e*, each formed substantially perpendicular to the respective leg, and inward so that the distal edge of each respective flange faces toward the opposite respective flange, so as to be substantially parallel to the web 30*a*. A gap exists between the distal edges of the respective flanges, the width of the gap being substantially the same as the outer dimension of the center rectangular tube 24.

Second end plain C-channel 32 is formed similarly, with a web 32*a*, substantially perpendicular legs 32*b*, 32*c*, and flanges 32*d*, 32*e* substantially perpendicular to the legs and substantially parallel to the web, ending with a gap existing between the distal edges of the respective flanges, the width of the gap being substantially the same as the outer dimension of the center rectangular tube 24.

Upon assembly, then, each end plain C-channel 30, 32 is applied over a respective shorter side of the tube 24, with the distal edges of the flanges contacting the outer surfaces of the longer sides of the tube, that is, the webs 26*a* and 28*a*, and the web 30*a*, 32*a* of each end plain C-channel 30, 32 overlaying the shorter sides of the tube 24, that is, the legs 28*b*, 28*c*. Each end plain C-channel 30, 32 is connected to the tube at some or all points of contact by any suitably permanent means, such as welding or adhesive.

To the longer sides of tube 24 are connected side U-channels 34, 36. Side U-channel 34 includes a web 34*a*, which is shorter than webs 26*a* and 28*a*. To each side edge of web 34*a* is a respective leg 34*b*, 34*c*. The width of each leg 34*b*, 34*c* is about the same as the width of flanges 30*d*, 32*d*. Thus the web 34*a* of the side U-channel 34 is substantially co-planar with the legs 30*b*, 32*b* of the end plain C-channels 30, 32. Similarly, side U-channel 36 includes a web 36*a*, which is shorter than webs 26*a* and 28*a*. To each side edge of web 36*a* is a respective leg 36*b*, 36*c*. The width of each leg 36*b*, 36*c* is about the same as the width of flanges 30*e*, 32*e*. Thus the web 36*a* of the side U-channel 36 is thus substantially co-planar with the legs 30*c*, 32*c* of the end plain C-channels 30, 32.

An end cap 40 may be applied to one or both ends of the outriggers 12. In the embodiment shown in FIGS. 3-5, end cap 40 is formed of a generally flat central body 42, having one of two ears 44 at each end of the body, the ears generally being not co-planar with the body, extending in the same direction as each other, transfer to the plane of the body. As shown best in FIGS. 3 and 4, the ears are affixed, by any suitably permanent means such as welding or adhesive, to the inner surfaces of the short sides of the center tube 24, that is, to legs 26*b* and 26*c* of inner slotted U-channel 26. As can be seen in FIG. 4, the end cap 40 is preferably recessed somewhat within the center tube 24.

In the embodiment shown, the end cap 40 includes an opening 46. Into the opening 46 may be fitted a threaded insert 48, for accepting a mating leveling foot (not shown). End C-channel 32 may also include one or more openings 50 formed at predetermined locations along the length thereof, into which may be fitted similar threaded inserts 52 for accepting various threaded fasteners. FIG. 1 shows wall struts 54 which are attached to the outriggers 12 in that fashion, the opposite ends of the wall struts 54 being affixed to any suitable support, such as a nearby portion of a ceiling (not shown) or a wall portion (not shown) behind or alongside the display system 10.

Figure 6A:
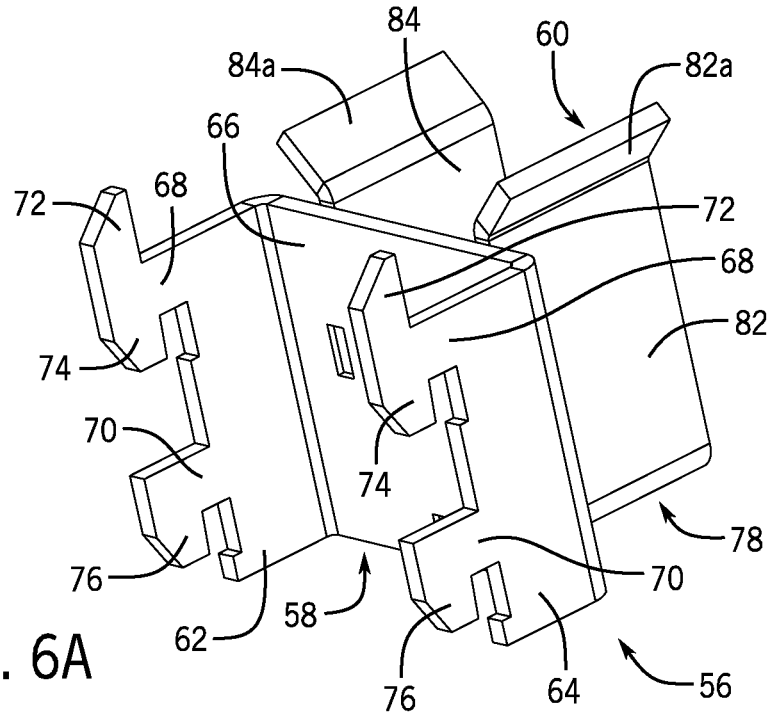
FIG. 6A is an isometric view of a saddle bracket constructed according to the invention, for use with the outrigger shown in FIGS. 2-5.
Figure 6B:
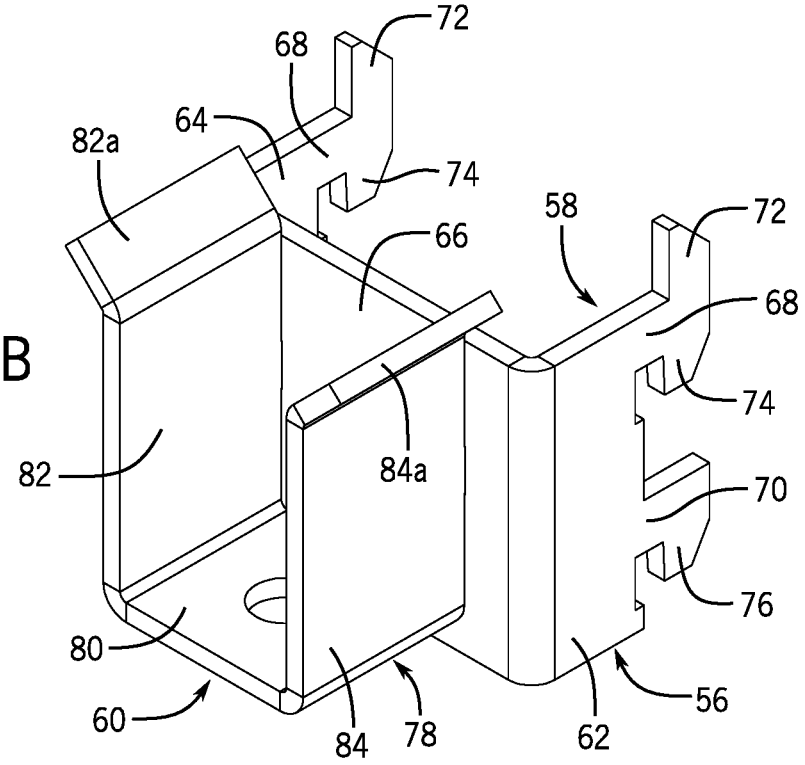
FIG. 6B is an isometric view of the saddle bracket shown in FIG. 6A, from the opposite direction.
Figure 7A:
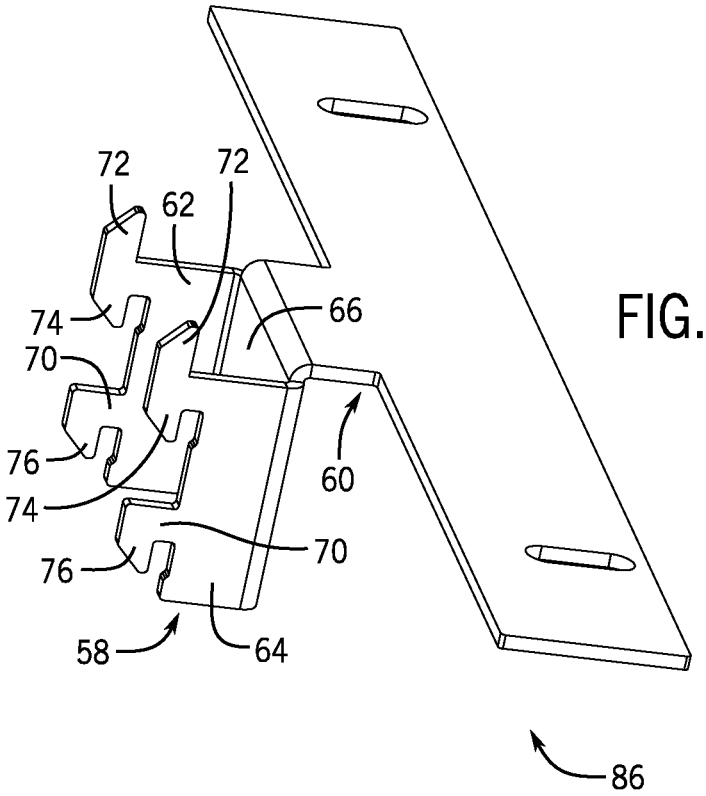
FIG. 7A is an isometric view of a shelf/box bracket constructed according to the invention, for use with the outrigger shown in FIGS. 2-5.
Figure 7B:
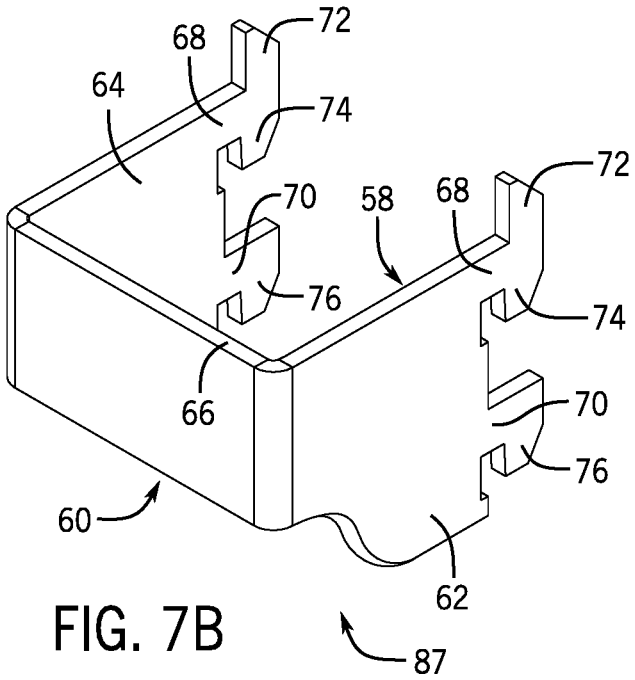
FIG. 7B is an isometric view of a hanger bracket constructed according to the invention, for use with the outrigger shown in FIGS. 2-5.
Figure 8:
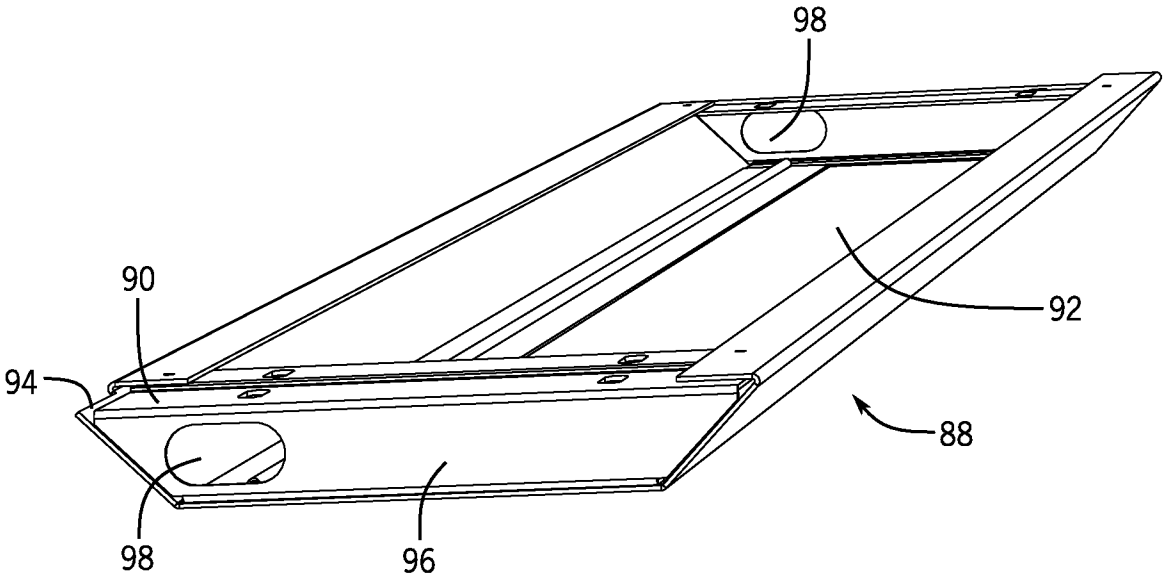
FIGS. 8-9 are isometric views of a wire chase constructed according to one embodiment of the invention.
Figure 9:
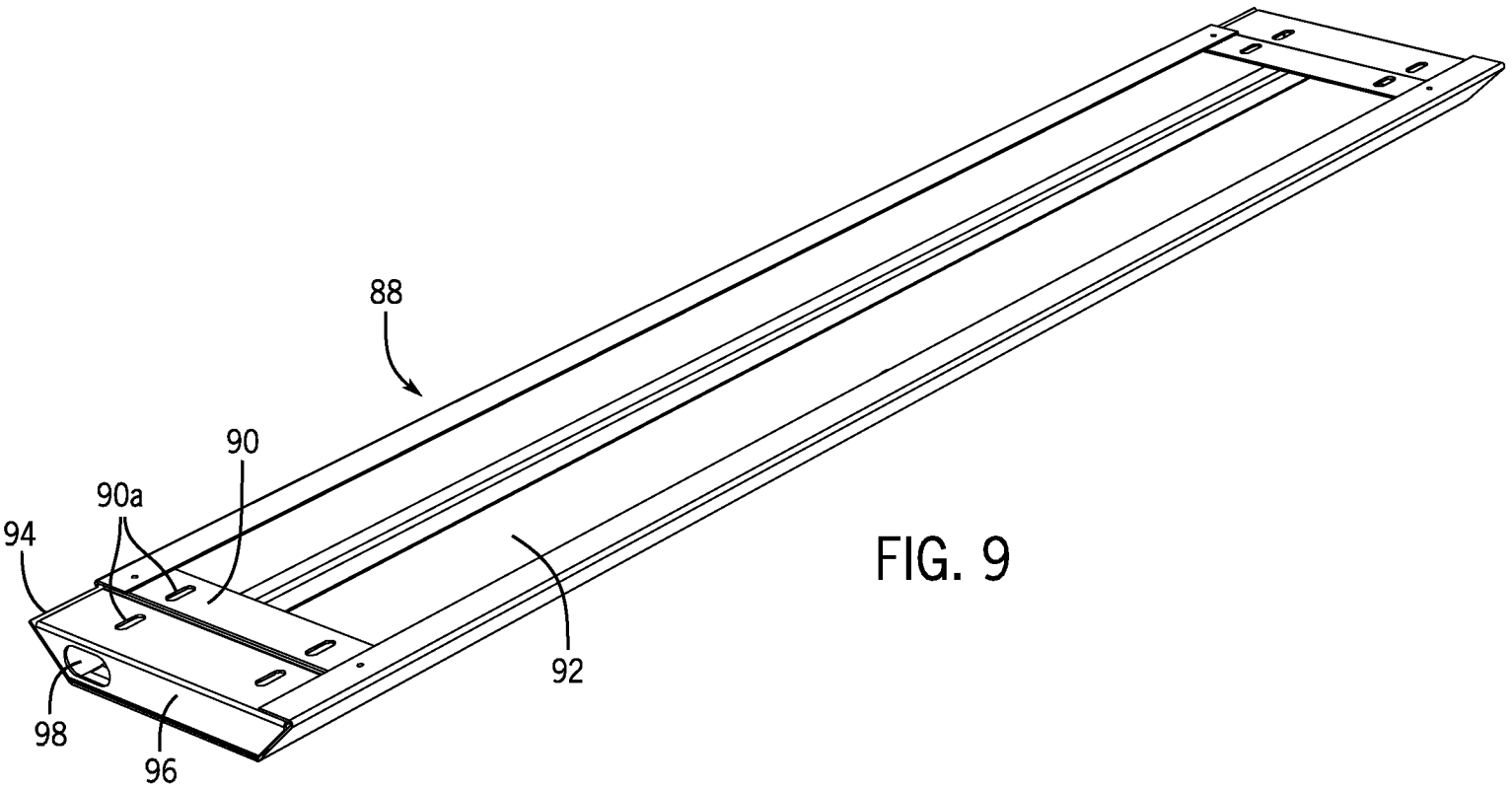
Figure 10:
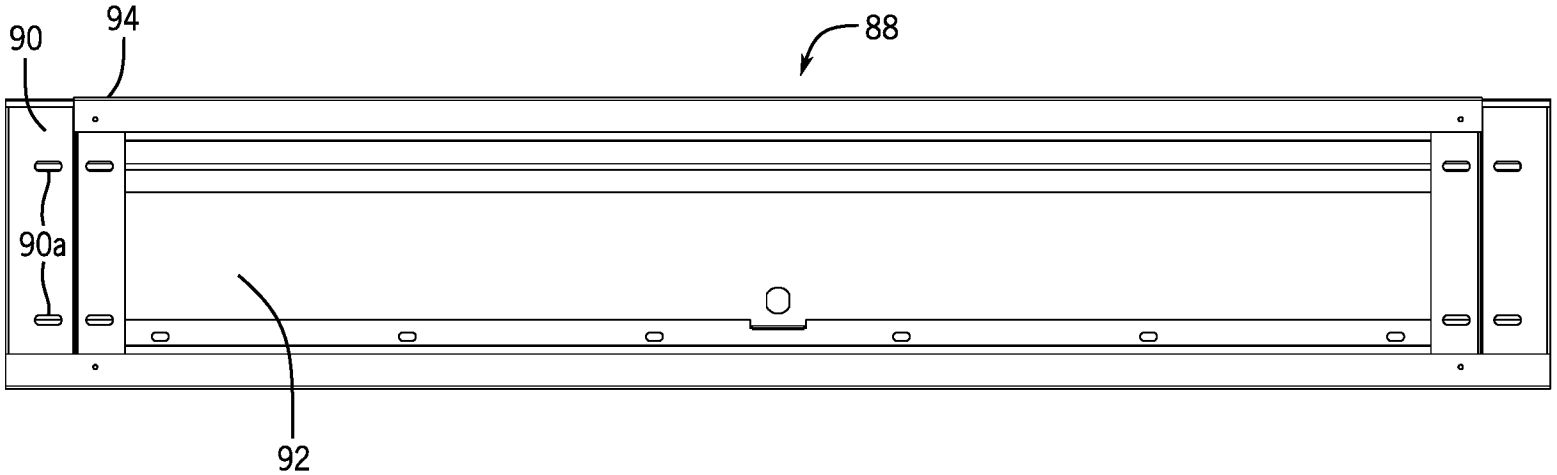
FIG. 10 is a top plan view of a wire chase constructed according to the invention.

FIGS. 6A and 6B show an example of a support 14, and FIGS. 7A and 7B show additional examples, although there are many other types of supports that could be constructed to fit within the system.

Shown in FIGS. 6A and 6B is a saddle bracket 56, having a mounting portion 58 and a support portion 60. As shown best in FIG. 6A, the mounting portion 58 is generally U-shaped, having two sides 62, 64, joined and spaced apart by a central web 66. Each side 62, 64 includes an upper ear 68 and a lower ear 70. Each upper ear 58 includes an upward hook 72 and a downward hook 74. Each lower ear 70 includes a downward hook 76. The support portion 60 includes a saddle 78, as shown best in FIG. 6B, for providing support to various fixtures, including but not limited to point of purchase displays, products and product messaging, technology, and further support systems. As shown there, the saddle 78 is generally of a squared-off U-shape, and includes a bottom 80, which is generally flat, although it may be concave, flanked on each lateral side by sidewalls 82, 84. The rear edge of the bottom 80 and both sidewalls 82, 84 are affixed to the central web 66 of the mounting portion 58, which is how the support portion 60 and the mounting portion are unified into a single item, the saddle bracket 56. At the top edge of each sidewall 82, 84 is a respective flare 82*a*, 84*a*, or small plate extending away from the opposite sidewall. The flares 82*a*, 84*a* are provided so as to make it easier to lay into the saddle bracket support portion 60 the point of purchase displays, products and product messaging, technology, and further support systems intended to be mounted and supported by the saddle brackets 56.

In use, the saddle bracket 56 is connected to an outrigger 12 by inserting the upward hooks upwardly into two laterally aligned slots 38 selected by the user, then pivoting the saddle bracket downward and inward toward the outrigger until both sets of ears 68, 70 are within respective slots, and then lowering the saddle bracket downward until the ears contact the lower edges of the respective slots. The upward hooks 72, ears 68 and 70, and slot 38 are sized relatively so that, once the bracket is thus lowered, both upward hooks are still trapped within the slot 38, as well of course as the lower ear downward hooks 76 also being trapped there.

Shown in FIG. 7A is a shelf bracket 86, for supporting any display item having a generally flat bottom, such as a shelf 16 or a bunker 18. Shelf bracket 86 includes ears and hooks the same as the saddle bracket 40, for mounting to an outrigger 12, and is connected using the same procedure. Shown in FIG. 7B is a hanger bracket 87, from which any appropriate display item may be hung. Hanger bracket 87 also includes ears and hooks the same as the saddle bracket 40, for mounting to an outrigger 12, and is connected using the same procedure.

Figure 11:
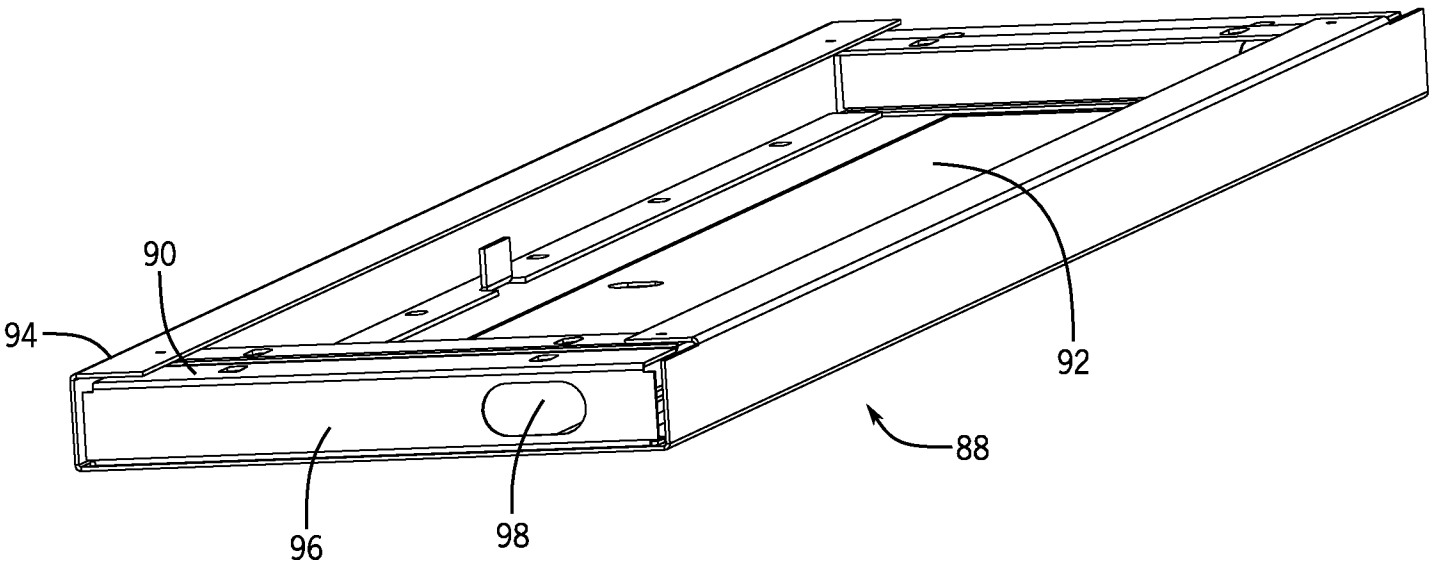
FIG. 11 is an isometric view of a wire chase constructed according to another embodiment of the invention.

Shown in FIGS. 8-11 is a useful item that can be mounted beneath a shelf 16 in display system 10, which useful item is a wire chase 88. The purpose of wire chase 88 is to manage and frankly hide any power and signal cables (not shown) that need to be connected to any items being displayed on the shelf, such as various electronic products including monitors 22. To that end, the wire chase 88 includes a mounting frame 90, having mounting slots 90*a* for mounting to the underside of a shelf. The wire chase 88 further includes a tray 92, ideally pivotably connected to the mounting frame 90 by means of a hinge 94. The tray 92 has side panels 96, one or both of which include cable openings 98, to permit passage of the power and signal cables. The tray 92 is where the managed cables (and possibly other items of support electronics, such as charger blocks) have room to reside. Tray 92, being hinged to the mounting frame 90, is preferably capable of being locked in a closed position, so as to be openable to allow access to the cabling, and at the same time restrict access to the cabling to authorized persons. In the embodiment shown in FIGS. 8 and 9, the long sides of the tray 92 are beveled or angled, so as to make the wire chase 88 less obvious to an observer. If placed in a certain way, the wire chase 88 can almost disappear entirely. At the same time, as shown in FIG. 11, the long sides of the wire chase 88 can simply be vertical, for simpler or less expensive construction, or to provide a different style.

Figure 12:
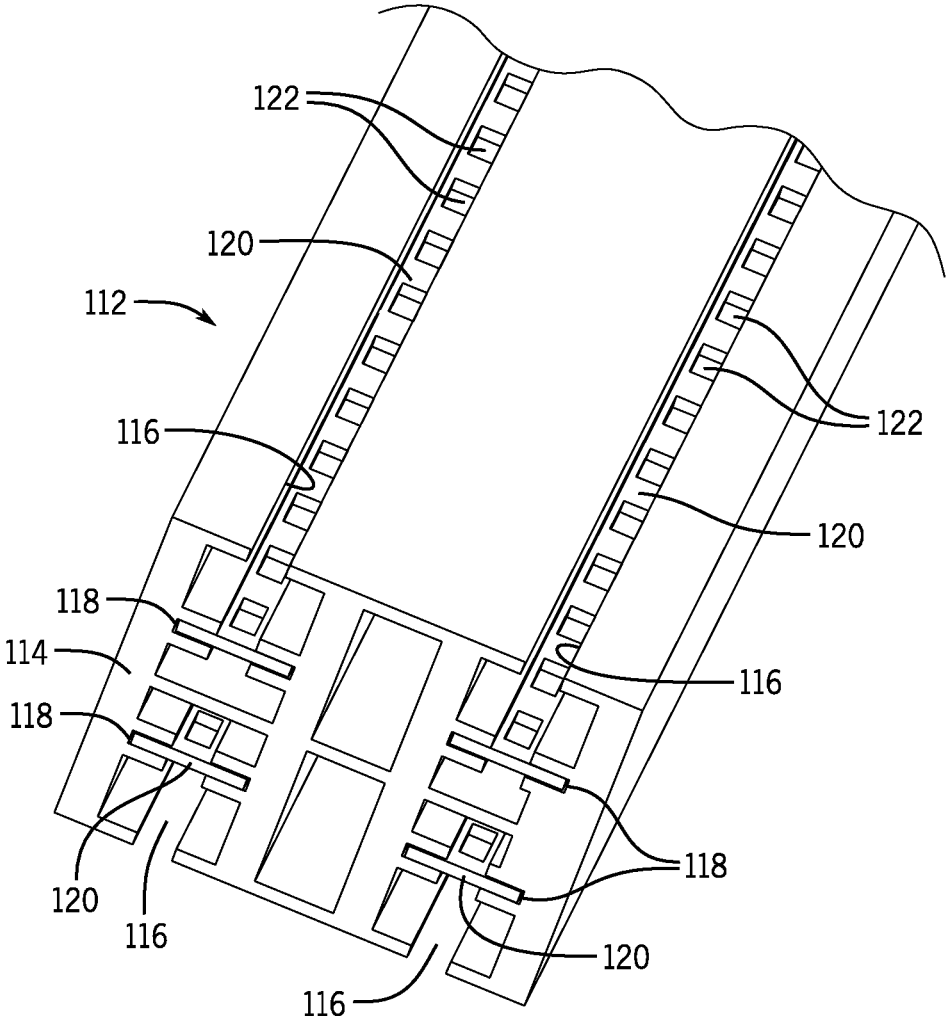
FIG. 12 is an isometric view of an outrigger constructed according to another embodiment of the invention.
Figure 13:
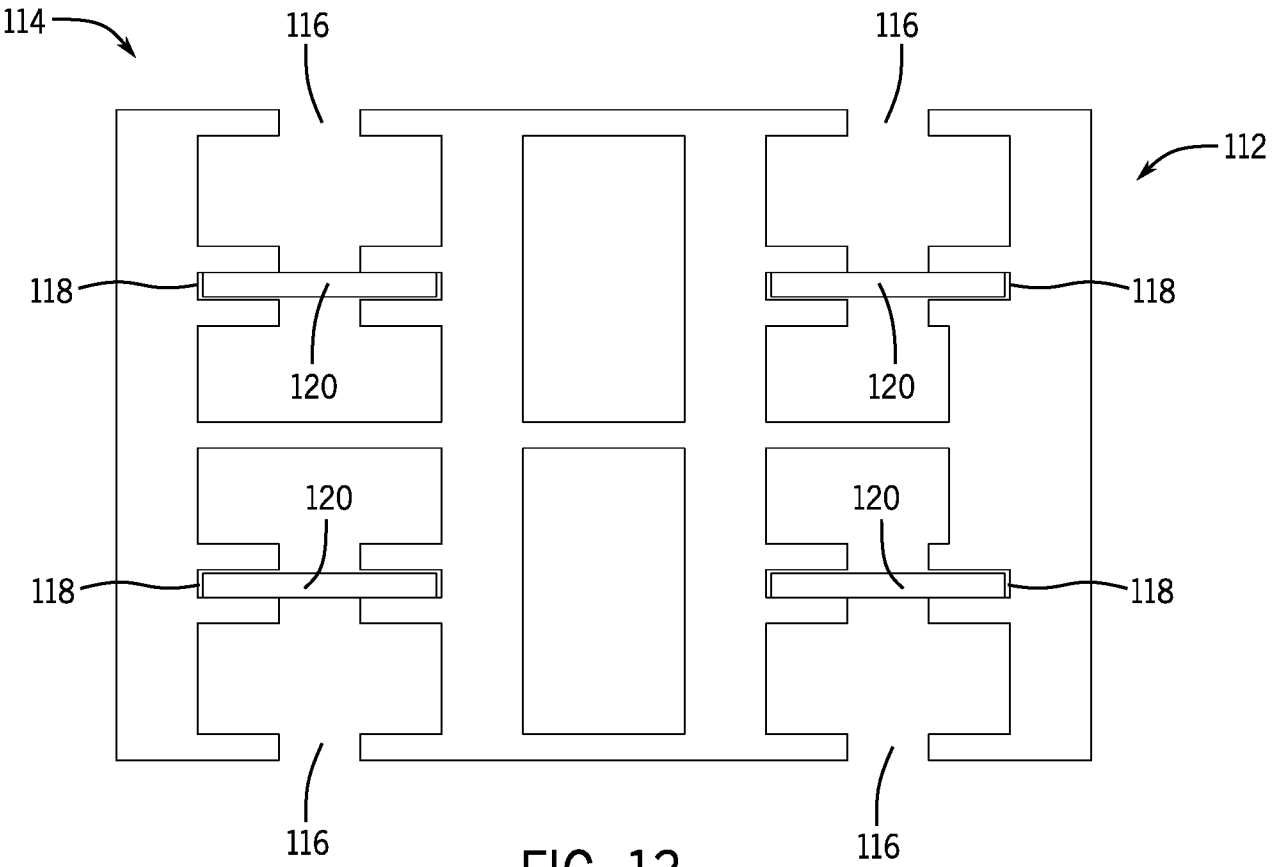
FIG. 13 is an end view of the outrigger shown in FIG. 12.

An alternative embodiment is shown in FIGS. 12 and 13. This alternative embodiment is generally for use in situations where extra strength may be required or where easier reparability, a lighter structure, or a cheaper construction may be desired. This embodiment provides outriggers 112 that may be constructed partially of extruded aluminum and partially of a stronger material, such as steel. As shown in FIGS. 12 and 13, an outrigger 112 includes an extruded body 114, having several sets of slots formed therein. The extruded body 114 may be less expensive to manufacture than a frame body with multiple members that all must be individually connected to one another. The extruded body 114 has a center body 114*a*, formed in a substantially figure-eight shape, and outer bodies 114*b*, 114*c*, located on either side of the center body 114*a* and connected to the center body 114*a* by flanges 114*d*, 114*e*. Two entry slots 116 are formed in each of the outer bodies 114*b*, 114*c*, generally parallel to one another and extending the length of the outer bodies 114*b*, 114*c*. Deeper within the outer bodies 114*b*, 114*c*, and aligned with the entry slots 116, there are formed plate slots 118. Into each plate slot 118 is slid a mounting plate 120, preferably made of the stronger material. Although, the mounting plate 120 may also be made of the same material as the body 114. The ease with which a worn or damaged mounting plate 120 may be replaced in this embodiment improves the reparability of the outrigger 112. Each mounting plate 120 includes a plurality of mounting slots 122 formed along its length, and positioned so as to be exposed to the outside of the outrigger 112. Mounting slots 122 are generally sized and positioned to function the same as slots 38 in the embodiment described above and shown in FIGS. 4 and 5.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A display mounting system comprising:

a rectangular mounting plate with a plurality of mounting slots extending therethrough, the mounting plate having a plate length, a plate width, and a plate thickness, and comprised of a first material;

an elongated body comprised of a second material, the elongated body having a body width, a body thickness and a body length that exceeds each of the body width and the body thickness, and two elongated plate slots formed substantially parallel to each other, each of the elongated plate slots having a plate slot length, a plate slot width, and a plate slot thickness, where the plate slot length exceeds each of the plate slot width and the plate slot thickness, with the elongated plate slots extending lengthwise substantially parallel to the body length; and two elongated entry slots extending lengthwise along the body length and substantially parallel to each other and to the elongated plate slots, wherein the mounting plate is positioned lengthwise within one of the elongated plate slots and substantially parallel to the body length, such that the mounting slots remain accessible to a removably mounted support bracket.

2. The display mounting system as recited in claim 1 wherein the support bracket has a mounting portion and a support portion and is removably mounted onto the mounting plate.

3. The display mounting system as recited in claim 1 wherein the first material is a different material than the second material.

4. The display mounting system as recited in claim 1 wherein the elongated body is extruded.

5. The display mounting system as recited in claim 4, wherein the removably mounted support bracket includes a mounting portion and a support portion, and wherein the mounting portion passes at least partially through the entry slots.

6. A method of forming the display mounting system as recited in claim 1 comprising:

forming via extrusion, the elongated body comprised of the first material, the body having the two elongated plate slots formed substantially parallel to each other and extending longitudinally along the elongated body, and the two elongated entry slots formed substantially parallel to each other and extending longitudinally along the elongated body;

forming the mounting plate comprised of the second material; and inserting the mounting plate lengthwise into one of the plate slots, such that the mounting plate extends substantially parallel to the entry slots.

7. The method as recited in claim 6, wherein the first material is a different material than the second material.

8. The method as recited in claim 7, further including securing the removably mounted support bracket to the mounting plate.

* * * * *